United States Patent [19]

Schneider

[11] 4,393,703

[45] Jul. 19, 1983

[54] SEALING ASSEMBLY FOR FURNACE PROBE BORE

[75] Inventor: Werner Schneider, Siegen, Fed. Rep. of Germany

[73] Assignee: Dango & Dienenthal Maschinenbau GmbH, Siegen, Fed. Rep. of Germany

[21] Appl. No.: 213,917

[22] Filed: Dec. 8, 1980

[30] Foreign Application Priority Data

Dec. 15, 1979 [DE] Fed. Rep. of Germany ..... 2950672

[51] Int. Cl.[3] ..... G01N 1/22; G01D 21/02

[52] U.S. Cl. ..... 73/432 R; 73/863.85

[58] Field of Search ..... 73/432 B, 863.85, 86; 251/172; 277/34, 34.3

[56] References Cited

U.S. PATENT DOCUMENTS

| | | | |
|---|---|---|---|
| 2,832,618 | 4/1958 | Knoll et al. | 277/34 |
| 3,229,526 | 1/1966 | Kennedy | 73/863.85 |
| 3,400,937 | 9/1968 | Crankshaw | 277/34 |
| 3,497,177 | 2/1970 | Hulsey | 251/172 |
| 3,542,054 | 11/1970 | Works | 251/172 |
| 4,054,060 | 10/1977 | Veno et al. | 73/863.85 |

*Primary Examiner*—S. Clement Swisher

*Attorney, Agent, or Firm*—Toren, McGeady and Stanger

[57] ABSTRACT

The bore in the shaft wall of a blast furnace through which a furnace probe is inserted is formed with a valve mechanism for shutting the probe bore when the probe is removed and with a sealing assembly located outwardly of the valve mechanism to prevent outburst of heat from the furnace while the probe is removed. A hose seal which bears against the blast furnace probe is connected to the sealing assembly on the side thereof opposite the valve mechanism.

11 Claims, 1 Drawing Figure

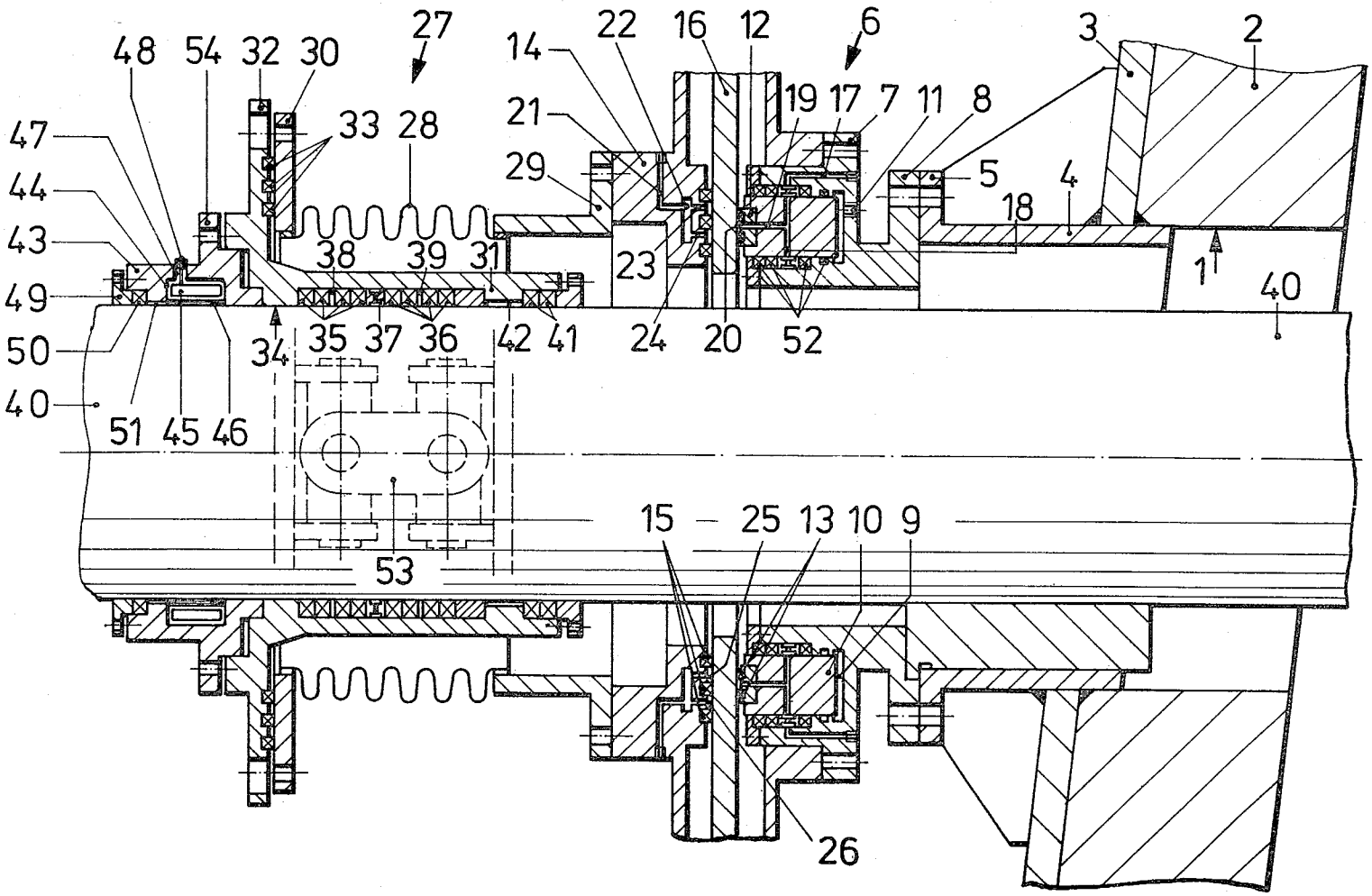
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54

SEALING ASSEMBLY FOR FURNACE PROBE BORE

The present invention relates generally to equipment for blast furnaces and more particularly to a probe bore attachment for the bore in the shaft wall of a blast furnace through which a blast furnace probe is received and removed. The probe bore attachment of the invention includes a valve mechanism and a sealing assembly.

A probe bore attachment of the type to which the present invention relates is known from German Patent No. 1,533,829. An attachment of this type essentially consists of a shutoff device and a seal. A short piece of pipe having a flange to which the shutoff device is attached is provided on the probe bore arranged in the shaft wall of the blast furnace. In the shutoff device, a goggle valve is supported between two flanges in order to be capable of pivoting about an axis which extends eccentrically relative to the two flanges while the sealing device is flanged to the flange of the shutoff device which faces away from the furnace.

The sealing device consists essentially of a stuffing box which bears in sealing engagement against the probe which is inserted into the blast furnace. The stuffing box includes a lubricating nipple for a libricant supply line which lubricant is supplied to the sealing rings of the stuffing box and to the periphery of the blast furnace probe extending through the seal.

Another probe bore attachment known from German Patent No. 1,408,098 consists essentially of a short piece of pipe which is arranged on the wall of the blast furnace shaft. A stop valve is provided and a stuffing box is arranged in front of the stop valve.

In the case of both known probe bore attachments, the probe bore in the shaft wall may be closed by the stop valve when the probe is removed from the furnace shaft. The distance between the stop valve and the stuffing box is dimensioned in such a way that the stop valve may be closed when the probe is moved out of the shaft wall but while the probe is still contained in sealed engagement in the region of the stuffing box so as to close part of the probe outwardly of the stop valve. When the stop valve is fully closed, the blast furnace probe may be fully removed from the bore or from the short piece of pipe.

When the probe is inserted into the bore, the stop valve is conversely opened only when the probe is inserted into the short piece of pipe up to the region of the stuffing box so that the probe may operate to effect sealing engagement within the bore outwardly of the stop valve before the stop valve is opened. In this manner, outbursts of gas and heat from the interior of the furnace will be prevented.

Introduction and removal of the blast furnace probe into the furnace bore in the furnace shaft wall leads to significant wear of the surface of the probe. It has been found that this wear is greatest at the tip of the probe and tends to decrease toward the rearward end of the probe. After a specific period of operation, a slender cone tends to be formed on the surface of the probe with the length of the cone corresponding approximately to the radius of the furnace.

The difference in the dimensions between the probe tip and the rearward end of the probe cannot be bridged by conventional sealing arrangements having relatively low elasticity. Therefore, dangerous outbursts of gas may occur when the worn forward portion of the probe is in the region of the sealing device of the probe bore attachment. Such a condition occurs because of the sealing ring or the sealing assembly provided in the probe or attachment will no longer bear in their totality in tight and sealing engagement against the respective portions of the probe tip along the entire length thereof. Accordingly, the sealing effect is impaired.

The sealing effect can be restored by appropriate readjustment. However, similar leaks will subsequently develop in later use of the probe because the conical probe again unduly widens the packings.

Conventional ball valves, plug discs, goggle valves or flaps may be used as stop valves in such probe bore attachments. In view of the increasing output of the blast furnace and the resulting pressure increase in the interior of such furnaces, known shut-off devices can no longer meet the requirements that are involved. Thus, there arises the danger that carbon monoxide may be discharged from the interior of the furnace and this represents a significant health risk to operating personnel.

Accordingly, the present invention is directed toward providing a probe bore attachment which will automatically adjust to substantial dimensional differences in the blast furnace probe which result from wear of the probe tip.

SUMMARY OF THE INVENTION

The present invention may be briefly described as an attachment for a probe bore for a blast furnace which includes a valve mechanism and a sealing assembly outwardly of the valve mechanism surrounding the probe bore, with the invention being particularly directed to the provision of a hose or tube seal which is connected to the sealing assembly and which can be pressed upon the probe as it is inserted and removed from the bore.

The especially high elasticity of the hose seal which adjusts to irregularities caused by wear of the probe tip will ensure that a tight and effective shutoff seal will always be guaranteed even in the case of substantial dimensional differences in the blast furnace probe.

As a result, health risks to working personnel in the vicinity of the blast furnace will be significantly reduced. This is true when the blast furnace probe is moved during a test run when the furnace probe pulled out of the sealing attachment, for example, in order to effect repairs on the probe itself or on the probe bore attachment.

Advantageously, the seal of the invention includes a housing for the hose seal. The housing can be provided with a connecting pipe for the hose seal for supplying and discharging hydraulic or pneumatic working medium in order to apply different pressures on the hose seal and to thereby enable it to adjust in an optimum manner to the respective conditions. Moreover, it is advisable to provide the inner circumference of the hose seal with a nonabrasive lining which could consist of a different material than the hose itself. In this case, the hose itself must only be designed for the application of the working medium because the frictional forces during movement of the blast furnace probe will be absorbed by the nonabrasive lining. Accordingly, after a certain amount of wear, only the nonabrasive lining must be replaced while the hose seal itself remains capable of further use.

A grease chamber is arranged in front of the hose seal in order to advantageously increase the sliding effect under the sliding surface of the lining by supplying a lubricant. The lubrication will be effected before the probe is moved in order to avoid caking of the seal together with the probe surface.

Advantageously, a higher pressure is applied to the hose seal when the probe is resting than when the probe is in sliding movement. For this purpose, the sealing attachment will be provided with adjusting valves for the admission of working medium to the hose seal with a higher or lower pressure.

It is accordingly possible, when no test runs are performed and when the blast furnace probe is in a stationary position, to press the hose of the hose seal filled with oil or gas in an especially tight manner against the probe surface by the application of high pressure. This will ensure an especially effective seal. In order to move the probe, the pressure may be lowered until a sliding engagement between the lining of the hose seal and the probe surface is possible while still maintaining an appropriate sealing effect.

The probe bore attachment is preferably provided with stop valves for pressing a lubricant into the grease chamber.

Additionally, sealing rings should be arranged on both sides of the stop valve. The sealing rings on one side of the stop valve are advantageously subjected to a certain amount of contact pressure. For opening and closing the shutoff device, the stop valve should be supported so as to be radially moveable in the shutoff device. An annular piston is advantageously arranged within the shutoff device on the side near the furnace with the sealing rings being arranged on the head of the annular piston. This results in the capability of pressing the sealing rings against the stop valve with different pressures. Moreover, annular changes can be provided between the sealing rings for the stop valve, with the annular chambers being connected to lubricant bores.

The sealing rings are advantageously under a higher pressure when the stop valve is stationary than when the stop valve is moving. In this regard, it is advantageous to provide stop valves for the admission of working medium to the annular piston under a high or low pressure in order to lower the pressure in the annular piston during the adjusting movement of the stop valve as well as in the hose seal. Moreover, stop valves for lubricant supplied to hollow spaces between the seals may be advantageously provided.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWING

The single FIGURE of drawing appearing in the application is a cross-sectional view of a probe bore attachment constructed in accordance with the present invention.

DETAILED DESCRIPTION OF THE PREFERRED EMBODIMENT

Referring now to the drawing, it will be seen that the present invention is directed to a probe bore attachment for the shaft wall 2 of a blast furnace comprising a probe bore 1 through which a blast furnace probe 40 may be inserted and removed.

The attachment of the present invention includes as basic elements thereof a shutoff valve device 6, a sealing assembly 27 and a hose seal 45 arranged adjacent each other outwardly of the shaft wall 2.

A short piece of pipe 4 is welded to a steel jacket 3 in front of the probe bore 1 in the shaft wall 2 of the blast furnace. The pipe 4 has at its free end a flange 5 to which the shut-off valve mechanism 6 is fastened. The housing 7 of the shutoff valve is connected to the flange 5 of the pipe 4 through a connecting flange 8. The housing 7 has an annular groove 9 within which an annular piston 10 is moveably supported.

For the admission of a working medium to the annular piston 10, the housing 7 includes a connecting bore 11 through which working medium may be hydraulically or pneumatically supplied to the annular piston 10. A head 12 of the annular piston 10 is additionally provided with annular seals 13.

A housing 14 is located opposite to the annular piston 10 and carries on a side thereof facing toward the furnace three sealing rings 15. A stop valve 16 is radially moveably arranged between the sealing rings 13 of the annular piston 10 and the sealing rings 15 of the housing 14.

The housing 7 is provided with a lubricant bore 17 which leads into another lubricant bore 18 of the annular piston 10. An additional lubricant bore 19 branches off from the bore 18 and leads to a hollow space 20 between the two sealing rings 13. In the same manner, the housing 14 is also provided with a lubricant bore 21 which leads to a collecting bore 22. Additional lubricant bores 23 and 24 branch off from the collecting bore 22 and lead to hollow spaces 25, 26 between the sealing rings 15.

When different pressures are applied to the annular piston 10 through the bore 11, different pressures on the annular seals 13 will be applied against the stop valve 16 and a corresponding pressure of the stop valve 16 will result against the annular seals.

In this manner, the sealing rings 13, 15 may be pressed with more or less force against the stop valve 16 in accordance with respective existing conditions.

The shutoff valve mechanism 6 is operatively attached with a connecting flange 32 of a seal housing 31 through a compensator 28 and through its connecting flange 29 of the compensator 28 at the housing 14 and through an oppositely located connecting flange 30 of the compensator 28.

Sealing rings 33 are arranged between the two flanges 30, 32. Several sealing assemblies 35, 36 are arranged at an internal bore 34 of the housing 31 with a spacer ring 37 for forcing in a neutral gas being provided between the assemblies 35 and 36. Between the individual sealing rings of the sealing assemblies 35 and 36, there are arranged rings 38 and 39 for forcing a lubricant between the individual sealing assemblies 35, 36 and a blast furnace probe 40. Furthermore, the housing 31 is provided with scraper rings 41 which, together with the housing 31, form a grease chamber 42.

Another housing 43 having a circumferential annular groove 44 for a hose seal 45 is connected with the housing 31 through a connecting flange 54. At its inner circumference, the hose seal 45 is formed with a non-abrasive lining 46 which is pressed directly against the blast furnace probe 40. In the hose housing 43 there is provided a connecting bore 47 for a line 48 through which a hydraulic or pneumatic working medium is admitted to the hose seal 45. The pressure of the working medium is adjusted in accordance with the respective conditions involved. For example, when the blast furnace probe 40 is at rest, it is advisable to admit a high pressure to the hose seal 45. When the probe 40 is moving, it is advantageous to reduce the prevailing pressure in the hose seal 45 so that a lower frictional force will result between the probe surface 40 and the nonabrasive lining 46. As used herein, the term "hose seal" is used to refer to a sealing device having a generally toroidal configuration surrounding the probe 40 and placed in direct sealing engagement therewith under fluid pressure.

Additionally, a scraper ring 50 is fastened to the housing 43 by means of a ring 49, with a grease chamber resulting between the housing 43, the scraper ring 50, the lining 46 and the probe 40. The annular piston 10 is sealed off by means of seals 52.

Instead of the annular piston 10, it is also possible to use a plurality of individual cylinders which are not illustrated in the drawing. Axial forces transmitted from the blast furnace probe 40 to the seal 27 are absorbed by the laterally arranged universal joints 53.

While a specific embodiment of the invention has been shown and described in detail to illustrate the application of the inventive principles, it will be understood that the invention may be embodied otherwise without departing from such principles.

I claim:

1. An attachment for a bore in the shaft wall of a blast furnace through which a blast furnace probe is received comprising, stop valve means, a sealing assembly, and a hose seal including an annular flexible element for slidably engaging said probe which bears against said blast furnace probe and which is connected to said sealing assembly.

2. An attachment according to claim 1 wherein said hose seal is arranged in a housing connected to said sealing assembly.

3. An attachment according to claim 1 or 2 wherein a connecting line for the admission of a working medium is provided for said hose seal.

4. An attachment according to claim 1 wherein said hose seal has an inner circumference which is provided with a nonabrasive lining.

5. An attachment according to claim 1 wherein said hose seal has a front opposite to said sealing assembly which is provided with a grease chamber.

6. An attachment according to claim 1 wherein sealing rings are arranged on opposite sides of said stop valve means taken axially of said bore.

7. An attachment according to claim 6 wherein said sealing rings on one side of said valve means bear against said valve means with a given pressure.

8. An attachment according to claims 6 or 7 wherein said stop valve means is radially moveable.

9. An attachment according to claim 1 wherein said stop valve means includes a stop valve member and an annular piston arranged within said stop valve means on a side of said stop valve member nearest said furnace, with sealing rings being provided on a head of said annular piston between said annular piston and said stop valve member.

10. An attachment for a bore in a shaft wall of a blast furnace through which an elongate blast furnace probe is operatively received by longitudinal movement of said probe through said attachment and bore into and out of said furnace, said attachment comprising, in combination, stop valve means for effecting a fluid seal when said probe is moved through said attachment, a hose seal comprising a toroidal hose member surrounding said probe and including an inner circumference pressed in direct contact against said probe during movement of said probe inwardly and outwardly of said furnace, said hose seal including fluid pressure means for applying a fluid pressure urging said hose member into sealing contact against said probe and an additional sealing assembly arranged adjacent said hose seal longitudinally of said probe for providing an additional sealing function between the outer surface of said probe and said attachment.

11. An attachment for a bore in the shaft wall of a blast furnace through which a blast furnace probe is received comprising, stop valve means, a sealing assembly, and a hose seal which bears against said blast furnace probe and which is connected to said sealing assembly wherein said stop valve means includes a stop valve member and an annular piston arranged within said stop valve means on a side of said stop valve member nearest said furnace, with sealing rings being provided on a head of said annular piston between said annular piston and said stop valve member and wherein annular chambers leading to lubricant bores are provided between said sealing rings for said stop valve member.

* * * * *